US011066795B2

(12) United States Patent
Saggiorato et al.

(10) Patent No.: US 11,066,795 B2
(45) Date of Patent: Jul. 20, 2021

(54) EQUIPMENT FOR CREATING A CROSS-COUNTRY SKI TRAIL

(71) Applicant: PRINOTH S.P.A., Vipiteno (IT)

(72) Inventors: Luca Saggiorato, Vipiteno (IT); Markus Unterholzner, Vipiteno (IT); Stefan Baier, Vipiteno (IT)

(73) Assignee: PRINOTH S.P.A., Vipiteno (IT)

( * ) Notice: Subject to any disclaimer, the term of this patent is extended or adjusted under 35 U.S.C. 154(b) by 0 days.

(21) Appl. No.: 16/090,971

(22) PCT Filed: Apr. 7, 2017

(86) PCT No.: PCT/IB2017/052021
§ 371 (c)(1),
(2) Date: Oct. 3, 2018

(87) PCT Pub. No.: WO2017/175193
PCT Pub. Date: Oct. 12, 2017

(65) Prior Publication Data

US 2019/0119872 A1 Apr. 25, 2019

(30) Foreign Application Priority Data

Apr. 7, 2016 (IT) ..... 102016000035923

(51) Int. Cl.
*E01H 4/02* (2006.01)

(52) U.S. Cl.
CPC ..... *E01H 4/02* (2013.01)

(58) Field of Classification Search
CPC ..... E01H 4/00; E01H 4/02
See application file for complete search history.

(56) References Cited

U.S. PATENT DOCUMENTS 4,110,919 A 9/1978 Henrichon
4,359,831 A * 11/1982 Beeley ..... E01H 5/098 172/112
4,523,398 A * 6/1985 Scheibel ..... E01H 4/02 172/140

(Continued)

FOREIGN PATENT DOCUMENTS

DE 8708508 4/1988
EP 0139959 5/1985

(Continued)

OTHER PUBLICATIONS

Notification Concerning Submission, Obtention or Transmittal of Priority Document for International Application No. PCT/IB2017/052021 dated Jul. 4, 2017.

(Continued)

*Primary Examiner* — Thomas B Will
*Assistant Examiner* — Joan D Misa
(74) *Attorney, Agent, or Firm* — Neal, Gerber & Eisenberg LLP

(57) ABSTRACT

Equipment for creating a cross-country ski trail for a vehicle; comprising a tracker device to form tracks in a snow cover; and a connection structure for coupling the tracker device to a first tiller or to the vehicle; the connection structure and the tracker device being connected to each other in a jointed manner around a first axis incident with the snow cover or the ground, such as transverse to a feed direction.

16 Claims, 5 Drawing Sheets

(56) References Cited

U.S. PATENT DOCUMENTS

| | | | | | |
|---|---|---|---|---|---|
| 4,788,783 | A * | 12/1988 | Bachler | E01H 4/02 | 172/393 |
| 5,142,800 | A * | 9/1992 | Hales | E01H 4/02 | 37/219 |
| 5,659,984 | A * | 8/1997 | Haug | A62D 3/02 | 37/219 |
| 6,481,123 | B1 * | 11/2002 | Kanzler | E01H 4/02 | 37/223 |
| 6,810,609 | B2 * | 11/2004 | Lassonde | E01H 4/02 | 172/123 |
| 2003/0051376 | A1 * | 3/2003 | Lassonde | E01H 4/02 | 37/348 |
| 2003/0154633 | A1 * | 8/2003 | Lassonde | E01H 4/02 | 37/219 |
| 2004/0144000 | A1 * | 7/2004 | Kanzler | E01H 4/02 | 37/196 |
| 2004/0173784 | A1 * | 9/2004 | Kanzler | B66D 1/505 | 254/267 |
| 2019/0112769 | A1 * | 4/2019 | Saggiorato | E01H 4/02 | |

FOREIGN PATENT DOCUMENTS

| | | |
|---|---|---|
| EP | 0216753 | 4/1987 |
| EP | 0461303 | 12/1991 |
| EP | 1754832 | 2/2007 |
| RU | 2 592 114 C2 | 6/2013 |

OTHER PUBLICATIONS

Notification of Transmittal of the International Search Report and the Written Opinion for International Application No. PCT/IB2017/052021 dated Jul. 10, 2017.

Russian Office Action for Application No. 2018138925 dated Jul. 24, 2020 (12 pages).

* cited by examiner

EQUIPMENT FOR CREATING A CROSS-COUNTRY SKI TRAIL

PRIORITY CLAIM

This application is a national stage application of PCT/IB2017/052021, filed on Apr. 7, 2017, which claims the benefit of and priority to Italian Patent Application No. 102016000035923, filed on Apr. 7, 2016, the entire contents of which are each incorporated by reference herein.

TECHNICAL FIELD

The present disclosure relates to equipment configured to create a cross-country ski trail, in particular a classic style cross-country ski trail.

BACKGROUND

Certain known pieces of equipment comprise a tracker device comprising at least one track-setter configured for creating tracks into the snow. A track for cross-country ski is a groove with a flat bottom face, two flared side faces, and having the function of guiding a ski. A track is formed by compressing the track-setter on the snow cover and simultaneously advancing the track-setter along a given path. In essence, the snow cover is locally compacted and deformed at each track by the track-setter.

Depending on the characteristics of the snow cover and to facilitate the forming of the tracks, the snow cover can be pre-treated by a main tiller having the purpose to groom the snow before the tracker device forms the tracks so as to facilitate the forming of the tracks. Depending on the environmental conditions, sometimes, it may be useful to groom a more or less shallow surface layer of the snow cover before forming the tracks, other times it is not necessary. The characteristics of the snow cover vary considerably depending on the environmental conditions. In other words, the snow cover can be soft or compact or with a hard surface crust and relatively soft on the inside, just to name some of the features that the snow cover can assume depending on the temperature, the humidity, and the thermal excursion. The forming of the tracks and the structure thereof can be strongly influenced by the variability of the characteristics of the snow cover.

Certain of these known pieces of equipment do not enable a high quality level to be obtained for classic style cross-country ski trails and high advancing speed for all types of snow cover.

SUMMARY

An object of the present disclosure is to provide equipment configured to create a cross-country ski trail that would reduce certain of the drawbacks of certain of the known art.

According to the present disclosure equipment configured to create a cross-country ski trails for a vehicle is provided; comprising a tracker device to form tracks in a snow cover; and a connection structure configured to couple the tracker device to a first tiller or to the vehicle; the connection structure and the tracker device being connected to each other in a jointed manner around a first axis incident with the snow cover or the ground, such as transverse to a feed direction.

In accordance with the present disclosure, the position of the tracker device is obtained in a jointed manner with respect to the tiller or to the vehicle around the first axis incident with the snow cover and this enables to have the relatively best track quality in particular in a curved direction. That is, the tracker device can better follow the curves or the inexactness of the snow cover and ensure tracks of relatively better quality. In other words, this configuration enables a relatively greater adaptability to the conditions of the snow cover and consequently a relatively better quality for the cross-country ski trails.

In particular, in a first embodiment, the tracker device comprises a slide which forms tracks in the snow cover and an auxiliary tiller connected in a non-revolving manner around the first axis and in a revolving manner around a second axis incident with the first axis and parallel to the snow cover. In this way, the slide forms the tracks where the auxiliary tiller has worked the snow because the revolving movements around the first axis of the auxiliary tiller and the slide are integral one with the other and, at the same time, the slide and auxiliary tiller can adapt to bumps or other snow cover contours in an independent manner.

In another embodiment, the equipment comprises the first slide and the tracker device and is connected in a revolving manner with respect to the first slide around the first axis due to a joint and around a second axis, incident with the first axis and, in certain embodiments, parallel to the snow cover by at least another joint.

In an embodiment, the equipment comprises the first tiller; the tracker device is connected to the first tiller by a jointed quadrilateral which enables revolving movements around a second axis incident with the first axis and, in certain embodiments, parallel to the snow cover.

In another embodiment, the equipment comprises the first tiller; the tracker device being connected to the first tiller by three joints and an actuator connected between two of the three joints; the three joints extend along a second axis incident with the first axis and, in certain embodiments, parallel to the snow cover.

In another embodiment, the equipment comprises the first tiller; the tracker device being connected in a non-revolving manner to the first tiller around a second axis incident with the first axis and, in certain embodiments, parallel to the snow cover.

Additional features are described in, and will be apparent from the following Detailed Description and the figures.

BRIEF DESCRIPTION OF THE DRAWINGS

Further features and advantages of the present disclosure will become apparent from the following description of a non-limiting embodiment thereof, with reference to the figures of the accompanying drawings, wherein.

DETAILED DESCRIPTION

Figure 1:
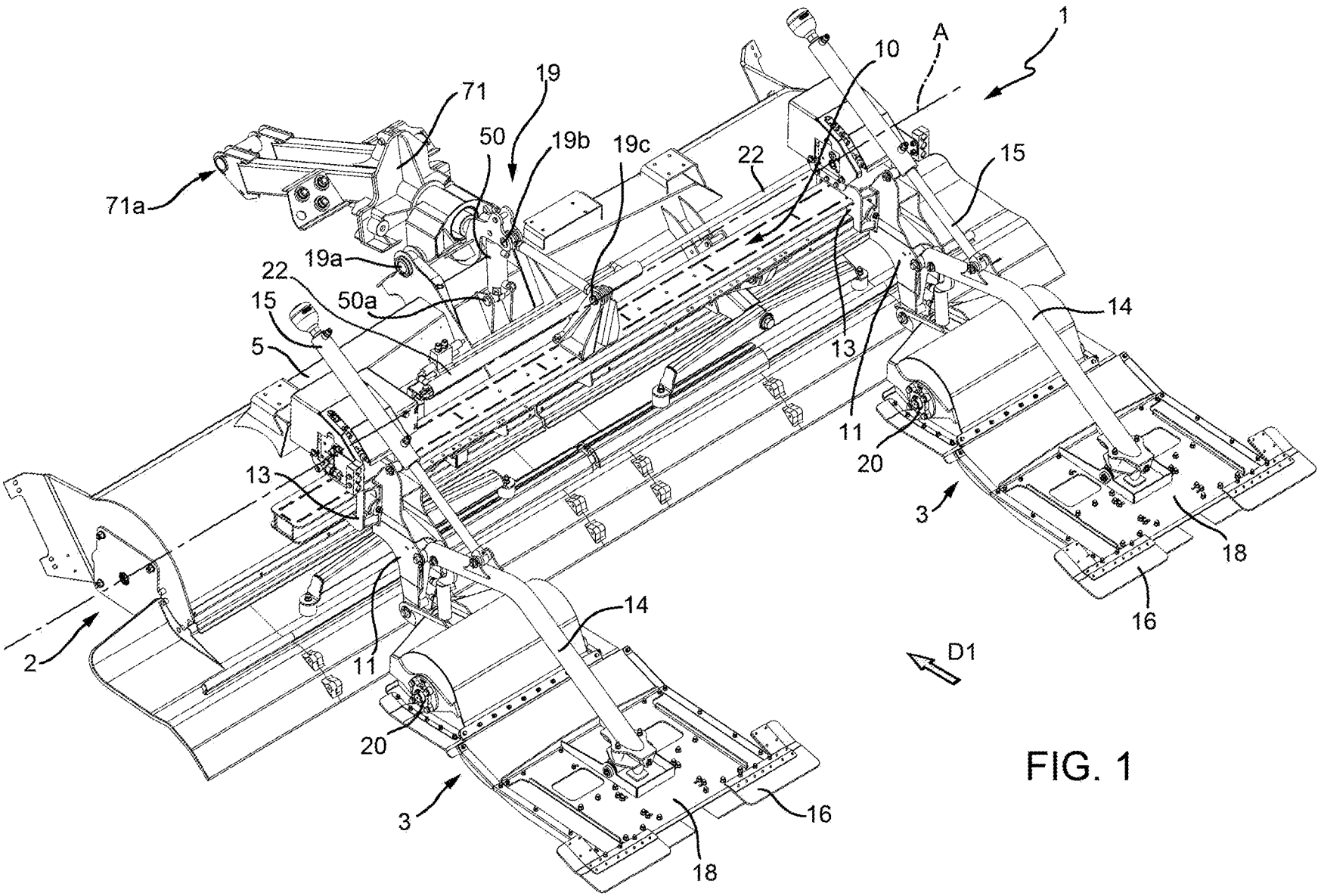
FIG. 1 is a perspective view, with parts removed for clarity, of equipment to form tracks for a cross-country ski trail according to a first embodiment of the present disclosure.
Figure 2:
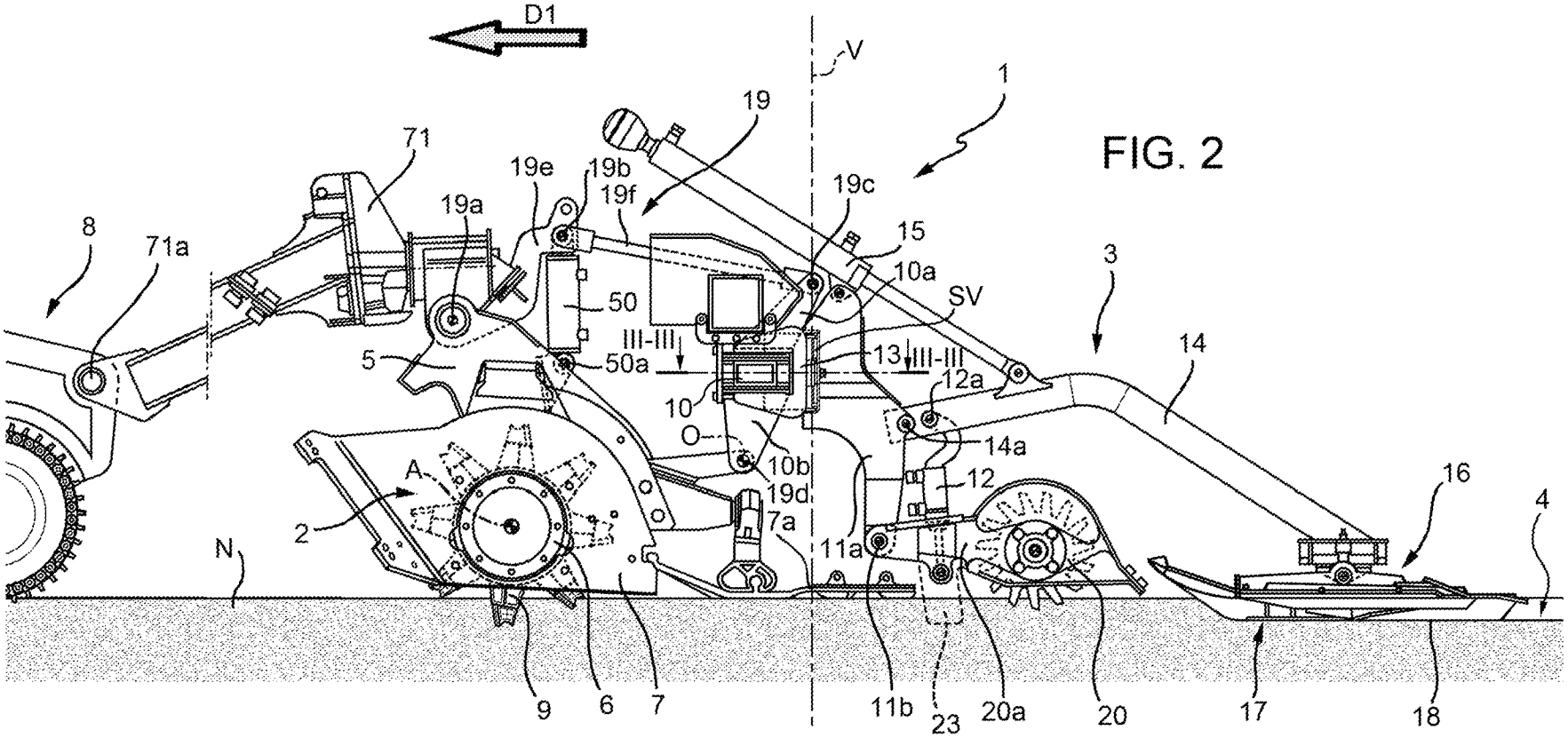
FIG. 2 is a side elevation view, with parts removed for clarity, of the equipment of FIG. 1 in a first operating configuration.

Referring now to the example embodiments of the present disclosure illustrated in FIGS. 1 to 5 and specifically referring to FIGS. 1 and 2, 1 denotes as a whole equipment configured to create a cross-country ski trail, in particular classic style cross-country ski trail. In the case illustrated in FIG. 1, the equipment 1 comprises a support structure 71 configured to support the equipment 1; a snow-tiller 2 supported by the support structure 71; two tracker devices 3 each forming, two tracks 4 parallel to a direction D1 corresponding to the feed direction of the equipment 1; and a connection structure 19 configured to connect the tracker devices 3 to the tiller 2 in a jointed manner so as to enable a rotation around an axis transverse to the direction D1 of the tracker devices 3 with respect to the tiller 2. In particular, the connection structure 19 connects the tracker devices 3 to the tiller 2 in a jointed manner with respect to an axis V which is transverse to the direction D1 and transverse to the snow cover N.

In particular, the axis V forms with the snow cover N or with the ground an angle ranging between 60° and 120°; such as between 60° and 90°, in particular between 75° and 90°. In one such embodiment, the axis V is perpendicular to the snow cover N or to the ground.

In addition, the connection structure 19 connects the tracker devices 3 to the tiller 2 in a jointed manner with respect to an axis O, which is transverse to the feed direction D1, in particular perpendicular; and parallel to the snow cover N, in particular not transverse to the snow cover N. Accordingly, the connection structure 19 connects the tracker devices 3 to the tiller 2 in a jointed manner around two axes incident one with the other, such as perpendicular; in particular the two axes are the axis V and the axis O.

For the connection in a jointed manner of two devices around an axis it is meant that the two devices can rotate one with respect to the other around said axis.

It should be appreciated that the quantity of two tracker devices is purely indicative and the present disclosure relates to a single tracker device or to a machine provided with more than two tracker devices.

In greater detail, each track 4 is substantially defined by a groove having a cross section substantially shaped as an isosceles trapezoid.

The equipment 1 is towed by a vehicle 8 and is connected to the vehicle 8 by the support structure 71. In greater detail, the support structure 71 comprises a connection unit 71*a* so as to be connected to vehicle 8. In various embodiments, the vehicle 8 is, but not limited to, a tracked vehicle, in particular a snow groomer.

With reference to FIG. 2, the tiller 2 comprises a frame 5, a shaft 6, a case 7 arranged around the shaft 6, and a mat 7*a* made of a flexible material.

The shaft 6 is mounted in a revolving manner around an axis A and is provided with teeth 9.

The tiller 2 is supported by the support structure 71. In particular, the tiller 2 is connected to the support structure 71 by the connection structure 19.

The connection structure 19 comprises a joint 19*a*, a joint 19*b*, a joint 19*c*, a joint 19*d*, an arm 19*e* which connects the joint 19*a* and the joint 19*b*, an arm 19*f* which connects the joint 19*b* to the joint 19*c*, and a guide 10.

The joint 19*a* extends parallel to the axis O and enables revolving movements around the axis O.

The joint 19*b* extends parallel to the axis O and enables revolving movements around the axis O.

The joint 19*c* extends parallel to the axis O and enables revolving movements around the axis O.

The joint 19*d* extends along the axis O and enables revolving movements around the axis O.

The axis O is parallel to the snow cover N or to the ground (i.e., not transverse to the snow cover N or to the ground).

The axis O is transverse to the feed direction D1 in particular perpendicular to the feed direction D1.

The frame 5 of the tiller 2 is directly connected to the support structure 71 by the joint 19*a*. Furthermore, the arm 19*e* is connected to the joint 19*a* and to the support structure 71. The frame 5 of the tiller 2 is connected to the support structure 71, to the joint 19*b* of the support structure 71.

The equipment 1 comprises an actuator 50 which connects the joint 19*b* to frame 5 of the tiller 2 and is configured to vary its length. In greater detail, the actuator 50 is connected to the joint 19*b* and to the frame 5 at a connecting point 50*a* differing from the joint 19*a*. Consequently, the distance between the frame 5 and the joint 19*b* can selectively vary depending on the variable length of the actuator 50.

The inclination of the tiller 2 with respect to a snow cover N can be varied by acting on a position of the connecting structure 71 and on the length of the actuator 50 which varies a configuration of the connection structure 19.

With reference to FIG. 1, the guide 10 of the connection structure 19 is substantially parallel to the axis A and/or to the axis O. The two tracker devices 3 are mounted in a sliding manner along the guide 10. Furthermore, the guide 10 is connected by an arm 10*a* to the joint 19*c* and by an arm 10*b* to the joint 19*d*.

In greater detail, the guide 10 is connected to the tiller 2 in the joint 19*d*. In particular, the guide 10 is connected to the frame 5 of the tiller 2 by the joint 19*d* of the connection structure 19.

With reference to FIGS. 1 and 2, each tracker device 3 comprises a support structure 11, which is coupled to the connection structure 19; an actuator 15; a slide 16; and a tiller 20.

Figure 3:
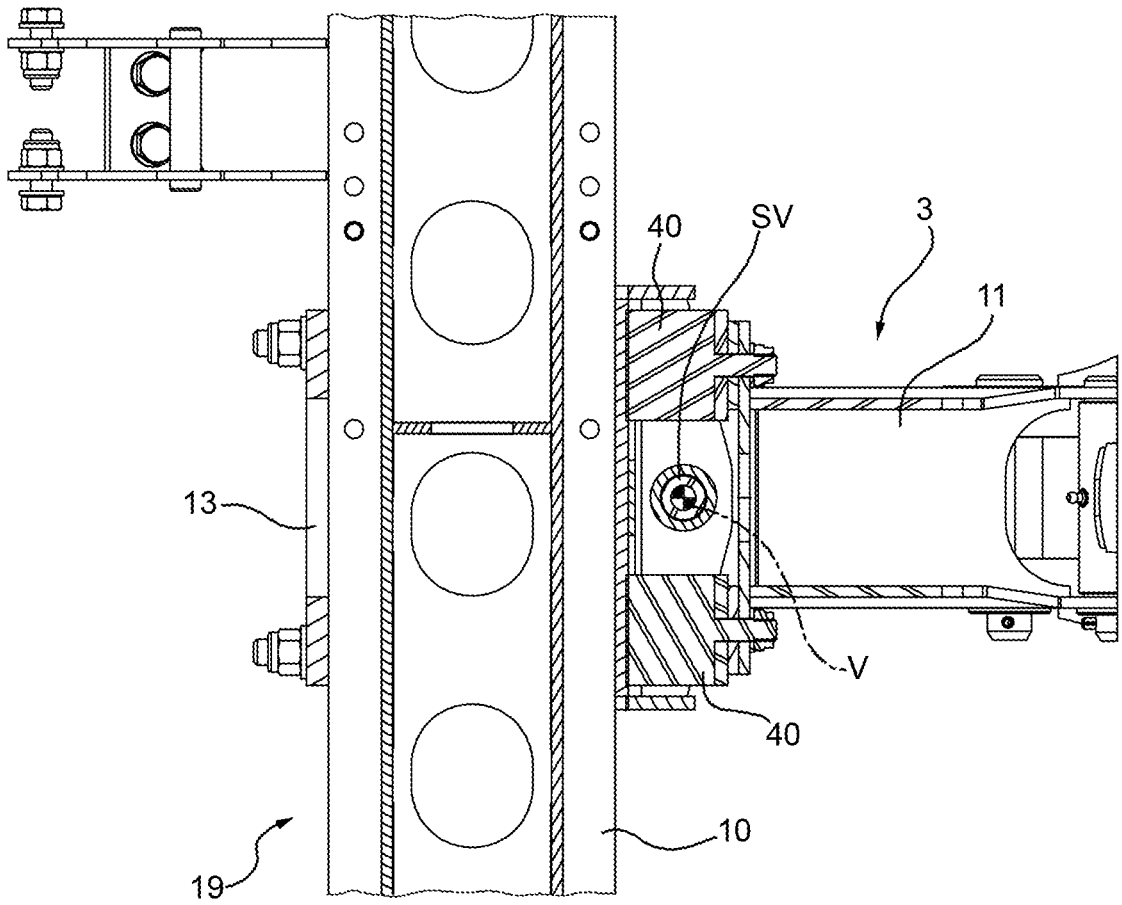
FIG. 3 is a sectional view according to the section plan with parts removed for clarity, of FIG. 2.

Referring to FIGS. 2 and 3, the connection structure 19 comprises a joint SV which develops along the axis V and enables rotations around the axis V. In greater detail, the joint SV is arranged between the support structure 11 of the tracker device 3 and the guide 10 of connection structure 19.

Referring to FIG. 3, the connection structure 19 comprises two elastic elements 40 arranged between the tracker device 3 and the connection structure 19 so as to force, due to the elastic force exerted by the same and within the limits thereof, the tracker device 3 in a main position. In one such embodiment, the main position is in axis with the feed direction. In particular, the two elastic elements 40 are arranged between the support structure 11 and the guide 10 from opposite sides with respect to the joint SV. In particular, the elastic elements 40 are made of an elastomeric material and also have the purpose of acting as a stop device.

The elastic elements can be made with a spring or other element having an elastic force. The elastic elements can also be defined by a single elastic element, for example a spring connected between the guide 10 and the support structure 11. The springs can be gas, pneumatic, mechanic actuated or of any other type.

Furthermore, each tracker device 3 is connected to the tiller 2 by the connection structure 19 so as to enable a free rotation around the axis O with respect to the tiller 2.

Each tracker device 3 is connected to the support structure 71 by the connection structure 19 so as to enable a free rotation around the axis O with respect to the support structure 71.

In addition, each tracker device 3 is connected to the tiller 2 by the connection structure 19, in particular by the joint SV, so as to enable a rotation around the axis V with respect to the tiller 2.

Each tracker device 3 is connected to the support structure 71 by the connection structure 19, in particular by the joint SV, so as to enable rotation around the axis V with respect to the support structure 71.

Each connection structure 19 comprises a slider 13 engaged with the guide 10.

Each support structure 11 comprises a central body 11*a* hinged to the slider 13 by the joint SV. Each support structure 11 comprises an elongated portion 14 hinged to the central body 11 a by a joint 14*a* which develops along an axis parallel to the axis O. The actuator 15 is arranged between the central body 11*a* and the elongated portion 14 to selectively arrange the elongated portion 14 in a working position, in which the tracker device 3 is in contact with the snow cover N and creates the tracks 4; and a rest position in which the tracker device 3 is raised from the snow cover N and does not create the tracks 4. In other words, the actuator 15 controls the rotation of the elongated portion 14 with respect to the central body 11*a* around the axis O.

In the attached figures, the tracker device 3 is always in the working position. In greater detail, the elongated portion 14 is connected to the central body 11*a* in a joint 14*a*. The joint 14*a* is secured to the actuator 15. In other words, the rotation of the elongated portion 14 with respect to the central body 11 a is obtained by the intervention of the actuator 15 and is not free.

With reference to FIGS. 1 and 2, the slide 16 is connected to the support structure 11 and is defined by a plate having a lower surface 17 flat and slightly curved upwards at the front edge; two track-setters 18, which are connected to the slide 16, protrude downwardly from the lower surface of slide 16 and are arranged at the rear edge of the slide 16. The two track-setters 18 define a work surface on which the tracks 4*v* are formed. The work plane is parallel to the snow cover and in use the work plane is superimposed on the snow cover N. The axis O is not incident with, in particular is parallel to the work plane. The axis V is incident with the work plane, in particular is perpendicular to the work plane.

The tiller 20 is coupled to the support structure 11. In particular, the tiller 20 is coupled to the elongated portion 14 by an arm 12 in a joint 12*a* and to the central body 11*a* of the support structure 11 in a joint 11*b*. The central body 11*a* is connected to the slider 13. The joints 12*a* and 11*b* extend along respective axes parallel to the axis O.

In the embodiment illustrated in FIG. 1, the equipment 1 comprises an actuator 22 which is adapted to move the slider 13 along the guide 10 and to adjust the distance between the tracker devices 3 in a direction transverse to the direction D1. In another embodiment (not illustrated in the accompanying figures), the actuator 22 is omitted.

In an optional embodiment of the present disclosure, the tracker device 3 comprises two blades 23 (illustrated in FIG. 2 with dashed lines) connected to a frame 20*a* of the tiller 20. The blades 23 are arranged between the tiller 20 and the tiller 2 in this case, each blade 23 is aligned with a track-setter 18.

The blade 23 has slightly greater dimensions than the size of the track-setters 18 and separates an elongated and continuous portion of snow cover N from the remaining part of the snow cover N. In use, the tiller 2 works a wide strip of snow cover N at a reduced depth, whereas the tillers 20 work on strips having a reduced width at a greater depth. The separation of the elongated and continuous portion results in a crumbling effect of the elongated and continuous portion which facilitates the forming of the track 4.

Each track-setter 18 is dragged along an elongated and continuous portion and compresses the snow cover N of said elongated and continuous portion based on the compression action exerted by the actuator 15.

The connection structure 19 defines a jointed quadrilateral for each tracker device 3 which connects the tracker device 3 with the tiller 2 and with the support structure 71. The jointed quadrilateral is formed by the joints 19*a*, 19*b*, 19*c* and 19*e*, by the elements 19*e* and 19*f*, by a frame portion 5 of the tiller 2 interposed between the joint 19*a* and the joint 19*d*, and by the arms 10*a*, 10*b* and the guide 10 interposed between the joint 19*c* and the joint 19*d*. The joints 19*a*, 19*b*, 19*c* and 19*e* extend parallel to the axis O and enable rotations around the axis O. In addition, the connection structure 19 by the joint SV enables rotation of the tracker devices 3 comprising the slide 16 and the tiller 20 with respect to the tiller 2 around the axis V. In other words, the slide 16 and the tiller 20 are connected to each other in a revolving manner around an axis parallel to the axis O which in turn is parallel to the snow cover N. The slide 16 and the tiller 20 are connected to each other in a non-revolving manner around the axis V, in other words the revolving movements of the slide 16 and of the tiller 20 around the axis V are integral one with the other.

Furthermore, the slide 16 and the tiller 20 are integral one with the other around the axis V and are connected in a revolving manner around the axis V with respect to the tiller 2 or to the vehicle 8. This enables the slide 16 to form the tracks where the tiller 20 has worked the snow cover N and there is no misalignment between the slide 16 and the tiller 20 whereas a misalignment between slide 16 and tiller 2 or between tiller 20 and tiller 2 is enabled. In this way, the slide 16 and the tiller 20 can work relatively better in a curved direction and form tracks 4 with relatively better curved profiles with respect to certain of the known art and at the same time ensure that the slide 16 forms the tracks 4 where the tiller 20 has worked the snow cover N. Finally, the tracker device 3 comprising the tiller 20 and the slide 16 does not make abrupt revolving movements around the axis V due to the elastic elements 40.

Furthermore, in accordance with the present disclosure, the position of the tiller 2 with respect to the snow cover N can be varied by the actuator 50 and/or the position of the support structure 71 without varying the position of the tiller 20 with respect to the snow cover N. That is, the position of the tiller 2 can vary from a first operating position to a second operating position based on the position of the support structure 71 and of the actuator 50, but the position of the tiller 20 with respect to the snow cover N does not vary due to the jointed connection around the axis O provided by the connection structure 19. In other words, the connection structure 19 provides a freely jointed connection around the axis O between the tiller 2, the support structure 71, and the tracker device 3. Consequently, the position of the tracker device 3 is not changed by the position of the tiller 2 and can be adjusted by the actuator 15 acting on the elongated portion which is connected to the central body 11*a* of the support structure 11.

The connection structure 19 provides a jointed connection around the axis O and around the axis V, significantly improving the working of the snow cover N so that the tracker device 3 can follow the conformation of the snow cover N.

Figure 4:
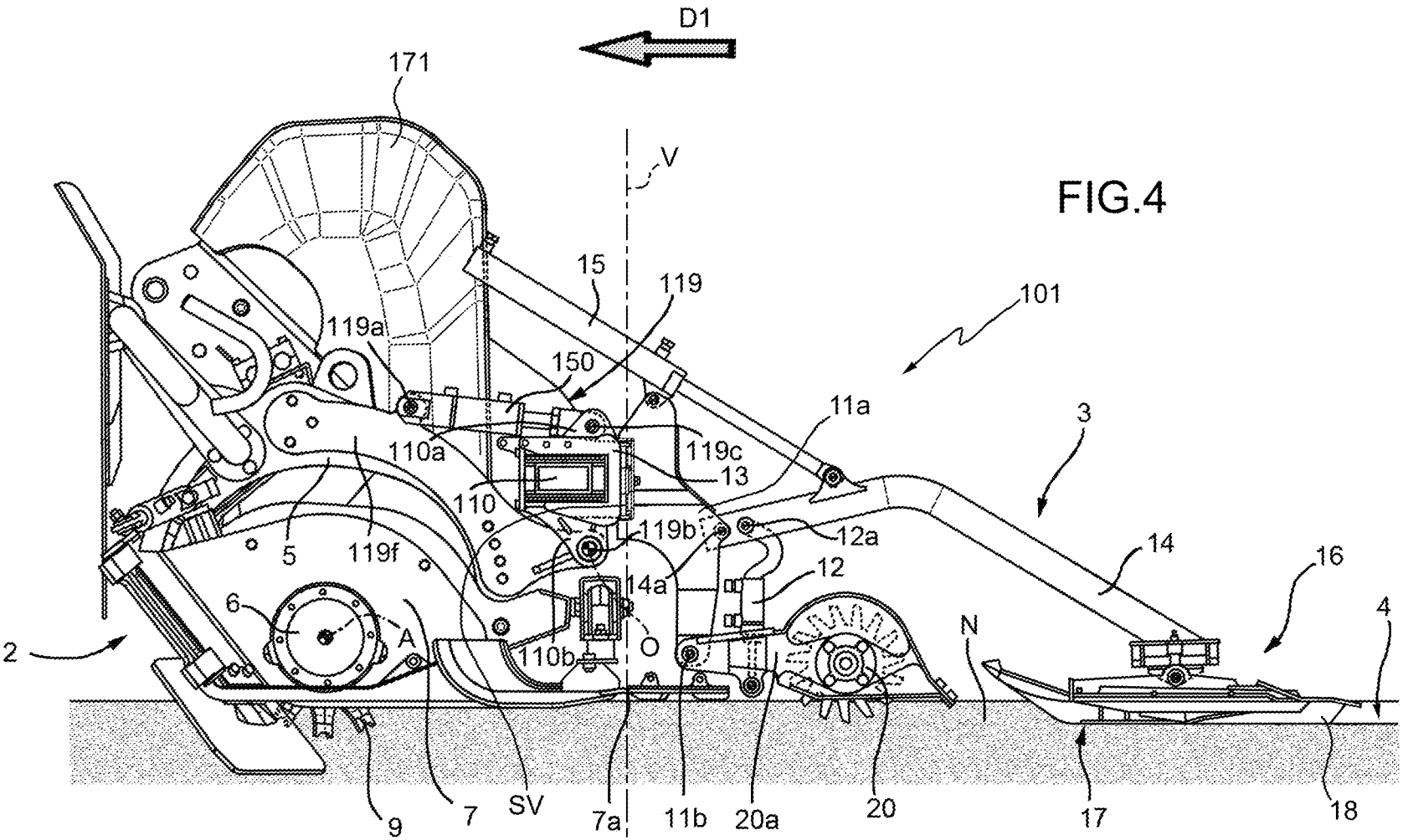
FIG. 4 is a side elevation view, with parts removed for clarity, of equipment to form tracks for a cross-country ski trail according to a second embodiment of the present disclosure.

Referring to FIG. 4, number 101 denotes a second embodiment of equipment configured to create a cross-country ski trail, alternative to the equipment 1. In the case illustrated in FIG. 4, the equipment 101 comprises a support structure 171 configured to support the equipment 101; a tiller 2 supported by the support structure 171; four tracker devices 3 (only one visible in FIG. 4) each forming, two tracks 4 parallel to a direction D1 corresponding to the feed direction of the equipment 1; and a connection structure 119 configured to connect the tracker devices 3 to the tiller 2 in a jointed manner to enable a rotation around an axis transverse to the direction D1 of the tracker devices 3 with respect to the tiller 2.

In particular, the connection structure 119 connects the tracker devices 3 to the tiller 2 in a jointed manner with respect to an axis V which is transverse to the direction D1, such as perpendicular; and transverse to the snow cover N, such as perpendicular to the snow cover.

In addition, the connection structure 119 connects the tracker devices 3 to the tiller 2 in a jointed manner with respect to an axis O which is transverse to the feed direction D1, in particular perpendicular; and parallel to the snow cover N, in particular non-transverse to the snow cover N. Accordingly, the connection structure 119 connects the tracker devices 3 to the tiller 2 in a jointed manner around two axis incident with one another, such as perpendicular; in particular the two axes are the axis V and the axis O.

It should be appreciated that the quantity of four tracker devices is purely indicative and the present disclosure refers to any quantity of tracker devices from one to more than four.

The equipment 101 is towed by a vehicle 8 (not shown in FIG. 4) and is connected to vehicle 8 by the support structure 171.

The tiller 2 and the tracker devices 3 of the equipment 101 are made in the same manner as those of the equipment 1 and are illustrated with the same numbers and not further described.

The equipment 101 differs from the equipment 1 mainly in the connection structure 119.

The tiller 2 is supported directly by the support structure 171. The frame 5 of the tiller 2 is directly connected to the support structure 171 at a connection point.

In addition, the tracker devices 3 are connected to the tiller 2 by the connection structure 119 and are not directly connected to the support structure 171. In other words, in the equipment 101, unlike the equipment 1, the tracker devices 3 are only connected to the tiller 2 by the connection structure 119.

The connection structure 119 comprises a guide 110; and an elongated element 119*f* connected along the frame 5 of the tiller 2. Furthermore, the connection structure 119 comprises a joint 119*a*, a joint 119*b* and a joint 119*c*. The joint 119*a* and the joint 119*b* are connected to the elongated element 119*f* of the connection structure 119.

The joint 119*a* extends parallel to the axis O and enables revolving movements around the axis O.

The joint 119*b* extends along the axis O and enables revolving movements around the axis O.

The joint 119*c* extends parallel to the axis O and enables revolving movements around the axis O.

In addition, the equipment 101 comprises an actuator 150 which is interposed between the joint 119*a* at the joint 119*c* and connects the same. The actuator 150 is selectively adjustable in length, therefore the distance between the joint 110*a* and the joint 119*c* is variable. Thus, the distance between the tiller 2 and the tracker devices 3 can be selectively varied according to the variable length of the actuator 150.

The inclination of the tiller 2 with respect to a snow cover N can be varied by acting on a position of the support structure 171.

With reference to FIG. 4, the guide 110 of the connection structure 119 is substantially parallel to the axis A and/or to the axis O. Along the guide 110, tracker devices 3 are mounted in a sliding manner. In addition, the guide 110 is connected, by an arm 110*a*, to the joint 119*c* in and from an arm 110*b* to the joint 119*b*.

In greater detail, the guide 110 is connected to the tiller 2 directly by the joint 119*b* and by the actuator 150 by the joint 119*c*. In particular, the guide 110 is only connected to the frame 5 of the tiller 2.

Moreover, each tracker device 3 is connected to the tiller 2 by the connection structure 119 so as to enable a free rotation around the axis O and around the axis V with respect to the tiller 2.

In greater detail, the connection structure 119 comprises a joint SV (equal to the joint SV of the connection structure 19) which extends along the axis V and enables rotations around the axis V.

In greater detail, the joint SV is arranged between the support structure 11 of the tracker device 3 and the guide 110 of the connection structure 119. The connection structure 119 comprises two elastic devices arranged between the tracker 3 and the connection structure 19 and arranged on opposite sides with respect to the joint SV as in the case of the connection structure 19.

The connection structure 119 defines a three-sided structure, in which the length of one of the sides is variable for each tracker device 3 that connects the tracker device 3 with the tiller 2 by the guide 110. The three-sided structure is formed by the joints 119*a*, 119*b*, 119*c*, by the elements 119*f*, by the guide 110, by the arms 110*a* and 110*b* of the guide 110, and by the actuator 150.

Consequently, each tracker device 3 is connected to the tiller 2 by the connection structure 119 so as to enable revolving movements around the axis O, based on the position of the actuator 150, due to the joints 119*a*, 119*b* and 119*c*.

Furthermore, each tracker device 3 is connected to the tiller 2 by the connection structure 119 so as to enable revolving movements around the axis V by the joint SV. In particular, as in the case of the equipment 1, the tiller 20 and the slide 16 are connected in a revolving manner around the axis O and in a non-revolving manner one with the other around the axis V. In other words, the revolving movements of the slide 16 and of the tiller 20 around the axis V are integral with each other. In addition, the slide 16 and the tiller 20 can perform revolving movements around the axis V with respect to the tiller 2 of the equipment 101.

Furthermore, the position of the tiller 2 with respect to the snow cover N can be varied due the actuator 150, without changing the position of the tiller 20 with respect to the snow cover N. As such, the position of the tiller 2 can vary from a first operating position to a second operating position, but the position of the tiller 20 with respect to the snow cover N does not vary due to the variation of the length of the actuator 150 which compensates for the variation in the position of the tiller 2. In other words, the connection structure 119 provides a jointed connection between the tiller 2 and the tracker device 3 around the axis O, based on the position of the actuator 150, and around the axis V. The distance of the tracker device 3 from the snow cover N, consequently, is not changed by the position of the tiller 2 and can be adjusted by the actuator 15 acting on the elongated portion 14 which is connected to the slider 13 of the support structure 11.

In an embodiment of the present disclosure not illustrated in the accompanying figures, the equipment 101 comprises a control unit which acts on the actuator 150 to adjust the length of the actuator 150 and on the support structure 171 for the position of the support structure 171 and consequently the position of the tiller 2. In other words, the movement of the support structure 171 and the movement of the actuator 150 are controlled by the control unit synchronously to ensure that when the position of the support structure 171 varies, to vary the position of the tiller 2, the position of the tracker device 3 does not vary. In other words, due to the control unit which simultaneously controls both the position of the support structure 171 and the actuator 150 the position of the tracker device 3 is independent of the position of the tiller 2.

Figure 5:
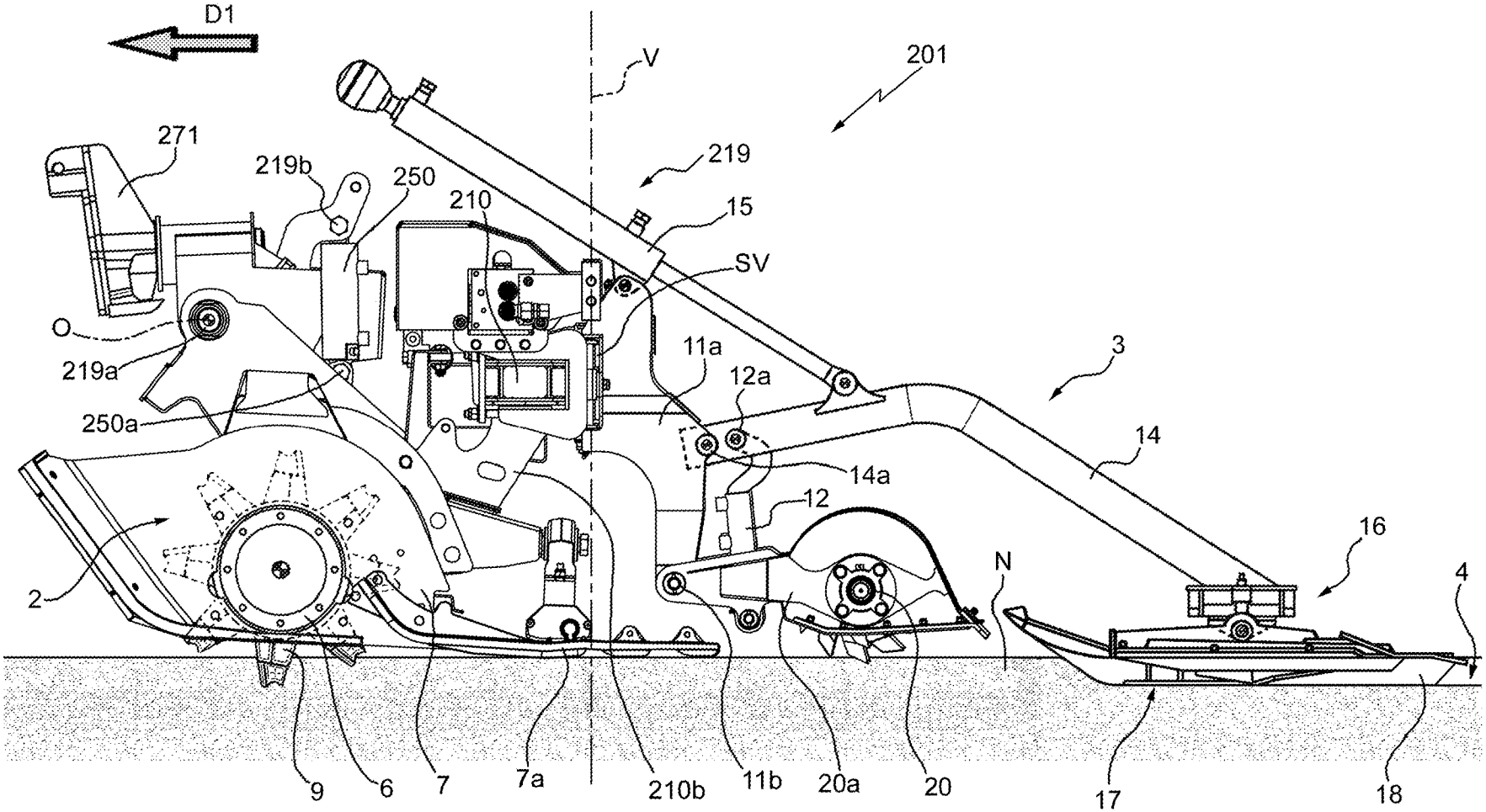
FIG. 5 is a side elevation view, with parts removed for clarity, of equipment to form tracks for a cross-country ski trail according to a third embodiment of the present disclosure.

With reference to FIG. 5, number 201 denotes a third embodiment of equipment configured to create a cross-country ski trail, as an alternative to the equipment 1. In the case illustrated in FIG. 5, the equipment 201 comprises a support structure 271 configured to support the equipment 201; a snow-tiller 2 supported by the support structure 271; Two tracker devices 3 (only one is visible in FIG. 5) each forming, two tracks 4 parallel to a direction D1 corresponding to the feed direction of the equipment 1; and a connection structure 219 configured to connect the tracker devices 3 to the tiller 2 in a jointed manner so as to enable a rotation around an axis transverse to the direction D1 of the tracker devices 3 with respect to the tiller 2.

In particular, the connection structure 219 connects the tracker devices 3 to the tiller 2 in a jointed manner with respect to an axis V which is transverse to the direction D1, such as perpendicular; and transverse to the snow cover N, such as perpendicular to the snow cover N.

In addition, the connection structure 219 connects the tracker devices 3 to the tiller 2 in a non-jointed manner around the axis A via the arm 210*b*.

The equipment 201 is towed by a vehicle 8 (not shown in FIG. 5) and is connected to the vehicle 8 by the support structure 271.

The tiller 2 and the tracker devices 3 of the equipment 201 are made in the same manner as those of the equipment 1 and are illustrated with the same numbers and not further described.

The equipment 201 differs from the equipment 1 mainly in connection structure 219.

The tiller 2 is supported directly by the support structure 271. The frame 5 of the tiller 2 is directly connected to the support structure 271 at a connection point.

In addition, the tracker devices 3 are connected to the tiller 2 by the connection structure 219 and are not directly connected to the support structure 271. In other words, in the equipment 201, unlike the equipment 1, the tracker devices 3 are only connected to the tiller 2 by the connection structure 219.

The connection structure 219 comprises a guide 210.

The connection structure 219 comprises a joint 219*a*, a joint 219*b*, an arm 19*e* which connects the joint 19*a* and the joint 19*b*, and the guide 210.

The joint 219*a* extends parallel to an axis O and enables revolving movements around the axis O.

The joint 219*b* extends parallel to the axis O and enables revolving movements around the axis O.

The axis O is parallel to the snow cover N or the ground (i.e., is not transverse to the snow cover N or to the ground).

The axis O is transverse to the feed direction D1 in particular perpendicular to the feed direction D1.

The frame 5 of the tiller 2 is directly connected to the support structure 71 by the joint 219*a*. In addition, the arm 219*e* is connected to the joint 219*a* and to the support structure 271. The frame 5 of the tiller 2 is connected to the support structure 271 to the joint 219*b* of the support structure 271.

The equipment 1 comprises an actuator 250 which connects the joint 219*b* to the frame 5 of the tiller 2 and is configured to vary its length. In greater detail, the actuator 250 is connected to the joint 219*b* and to the frame 5 at a connection point 250*a* other than the joint 219*a*. Consequently, the distance between the frame 5 and the joint 219*b* can vary according to the variable length of the actuator 250.

The inclination of the tiller 2 with respect to a snow cover N can be varied by acting on a position of the support structure 271 and on the length of the actuator 250 which varies a configuration of the connection structure 219.

The guide 210 of the connection structure 219 is substantially parallel to the axis A and/or the axis O. The two tracker devices 3 are mounted in a sliding manner along the guide 210. The guide 10 is also connected by an arm 210*b* of the connection structure 219 to the tiller 2.

In particular, the guide 210 is connected to the frame 5 of the tiller 2 by the arm 210*b* of the connection structure 19 in an integral manner.

Furthermore, each tracker device 3 is connected to the tiller 2 by the connection structure 119 so as to enable a free rotation around the axis V with respect to the tiller 2.

In greater detail, the connection structure 119 comprises a joint SV (equal to the joint SV of the connection structure 19) which develops along the axis V and enables rotations around the axis V.

In greater detail, the joint SV is arranged between the support structure 11 of the tracker device 3 and the guide 210 of the connection structure 219. The connection structure 219 comprises two elastic devices arranged between the tracker 3 and the connection structure 219 and arranged on opposite sides with respect to the joint SV as in the case of the connection structure 19.

In addition, each tracker device 3 is connected to the tiller 2 by the connection structure 219 so as to enable revolving movements around the axis V, due to the joint SV. In particular, as in the case of the equipment 1, the tiller 20 and the slide 16 are connected to each other in a revolving manner around the axis O and to each other in a non-revolving manner around the axis V. In other words, the revolving movements of the slide 16 and of the tiller 20 around the axis V are integral one with the other. In addition, the slide 16 and the tiller 20 can perform integral and revolving movements together around the axis V with respect to the tiller 2 of the equipment 201.

It should be appreciated that in accordance with the present disclosure, the tiller 20 and the slide 16 in a curved direction define the tracks 4 having improved profiles with respect to the known art and is ensured that the slide 16 works a portion of the snow cover N which has been previously worked by the tiller 20.

As mentioned above and for all the embodiments, the slide 16 defines a work plane (corresponding to a plane on which it forms the tracks 4). In an embodiment, applicable to all the pieces of equipment described above, therefore to the equipment 1, to the equipment 101 and to the equipment 201, the axis V is incident with the work plane defined by the slide 16. In particular, the axis V forms with the work plane an angle of between 60° and 120°; such as between 60° and 90°, in particular between 75° and 90°.

It is finally apparent that modifications and alternatives can be made to the equipment without departing from the scope of the accompanying claims. As such, the present disclosure also covers embodiments not described in the detailed description and equivalent embodiments that fall within scope of the appended claims. Accordingly, various changes and modifications to the presently disclosed embodiments will be apparent to those skilled in the art. Such changes and modifications can be made without departing from the spirit and scope of the present subject matter and without diminishing its intended technical scope. It is therefore intended that such changes and modifications be covered by the appended claims.

The invention claimed is:

1. Cross-country ski trail creation equipment comprising:

a tracker device configured to form a plurality of tracks in a snow cover;

a connection structure connecting the tracker device to a first tiller, wherein the connection structure is connected to the tracker device in a jointed manner around a first axis, and the first axis is transverse to a feed direction and transverse to the snow cover; and a support structure connectable to a vehicle and comprising a joint which extends parallel to a second axis transverse to the first axis, wherein the connection structure is revolvably connectable to the support structure by the joint around the second axis to enable a free rotation around the second axis, and wherein the connection structure connects the tracker device to the first tiller in a jointed manner around the second axis.

2. The cross-country ski trail creation equipment of claim 1, wherein the first axis defines, with the snow cover, an angle of between 60° and 120°.

3. The cross-country ski trail creation equipment of claim 1, wherein the tracker device is connected to the connection structure by a joint along the first axis to enable revolving movement around the first axis.

4. The cross-country ski trail creation equipment of claim 1, wherein the connection structure comprises a first elastic element arranged between the connection structure and the tracker device to place the tracker device into a first position.

5. The cross-country ski trail creation equipment of claim 4, wherein the connection structure comprises a fixed element and the tracker device has a support structure connectable in a jointed manner to the fixed element around the first axis, the first elastic element being interposed between the fixed element and the support structure.

6. The cross-country ski trail creation equipment of claim 5, wherein the connection structure comprises a second elastic element, the first elastic element and the second elastic element being housed on opposite sides of a joint.

7. The cross-country ski trail creation equipment of claim 1, wherein the tracker device comprises a slide configured to form the plurality of tracks in the snow cover and a second tiller connectable to the slide in a non-revolving manner around the first axis.

8. The cross-country ski trail creation equipment of claim 1, wherein the connection structure connects the tracker device to the first tiller in a jointed manner around the first axis.

9. The cross-country ski trail creation equipment of claim 1, wherein the second axis is parallel to the snow cover.

10. The cross-country ski trail creation equipment of claim 1, wherein the tracker device comprises a support structure and a slide, the support structure being revolvably connectable to one of: the first tiller and the vehicle, by the connection structure, around the first axis.

11. The cross-country ski trail creation equipment of claim 10, wherein the slide is connectable to an elongated portion of the support structure, the elongated portion being connectable to a body of the support structure by a joint which is parallel to the second axis and by an actuator configured to selectively adjust a position of the elongated body with respect to the body of the support structure.

12. The cross-country ski trail creation equipment of claim 1, wherein the connection structure comprises a first arm and the tracker device is integrally connected to the first tiller by the connection structure via the first arm.

13. The cross-country ski trail creation equipment of claim 12, wherein the first tiller comprises a frame and the connection structure comprises a first joint and a second arm which connects the first joint to a second joint and further comprising an actuator having a selectively adjustable length which connects the frame of the first tiller to the first joint such that a distance between the frame and the first joint is selectively adjustable.

14. Cross-country ski trail creation equipment comprising:

a tracker device configured to form a plurality of tracks in a snow cover;

a connection structure connecting the tracker device to a first tiller, wherein the connection structure is connected to the tracker device in a jointed manner around a first axis, and the first axis is transverse to a feed direction and transverse to the snow cover; and a support structure connectable to a vehicle and comprising a joint which extends parallel to a second axis transverse to the first axis, wherein the connection structure is revolvably connectable to the support structure by the joint around the second axis to enable a free rotation around the second axis and the connection structure comprises a jointed quadrilateral having four joints and which connects the tracker device to the first tiller such that the tracker device is freely rotatable around the second axis.

15. The cross-country ski trail creation equipment of claim 14, wherein the second axis is parallel to the snow cover and the tracker device is configured to be positioned, with respect to the snow cover, independent of a position of the first tiller with respect to the snow cover.

16. Cross-country ski trail creation equipment comprising:

a tracker device configured to form a plurality of tracks in a snow cover;

a connection structure connecting the tracker device to a first tiller, wherein the connection structure is connected to the tracker device in a jointed manner around a first axis, and the first axis is transverse to a feed direction and transverse to the snow cover, the connection structure comprising a first joint, an actuator having a selectively adjustable length, and a second joint connectable to a third joint by the actuator such that a distance between the second joint and the third joint is selectively adjustable, the second joint being connectable to the tracker device by a fourth joint; and a support structure connectable to a vehicle and comprising a fifth joint which extends parallel to a second axis traverse to the first axis, wherein the connection structure is revolvably connectable to the support structure by the fifth joint around the second axis to enable a free rotation around the second axis, and wherein the first joint of the connection structure extends along the second axis and is revolvably connectable to the vehicle around the second axis.

* * * * *